United States Patent [19]

Barnes et al.

[11] 4,421,149

[45] Dec. 20, 1983

[54] PROCESS FOR PREPARATION OF LONG WOOD STRANDS

[75] Inventors: Derek Barnes, Vancouver; Mark T. Churchland, Burnaby; Arnold W. Herndier, Burnaby; James K. Welsh, Burnaby, all of Canada

[73] Assignee: MacMillan Bloedel Limited, Vancouver, Canada

[21] Appl. No.: 199,191

[22] Filed: Oct. 21, 1980

Related U.S. Application Data

[63] Continuation-in-part of Ser. No. 885,985, Mar. 13, 1978, abandoned.

[51] Int. Cl.[3] ..... B27L 7/00

[52] U.S. Cl. ..... 144/366; 83/345; 144/3 K; 144/193 R; 144/367; 144/193 A

[58] Field of Search ..... 225/97; 83/156, 425.2, 83/425.3, 345, 906; 144/1 R, 3 R, 182, 183, 184, 185, 190, 193 R, 193 A, 3 K, 193 J, 322, 321, 323, 326 R, 326 D, 366, 367, 369

[56] References Cited

U.S. PATENT DOCUMENTS

| | | | |
|---|---|---|---|
| 546,294 | 9/1895 | Birkner | 144/193 R |
| 682,228 | 9/1901 | Parker | 144/193 R X |
| 1,376,789 | 3/1921 | Williams . | |
| 2,006,106 | 6/1935 | Markert | 83/425.3 |
| 2,084,921 | 6/1937 | Skliris | 83/425.3 |
| 2,514,915 | 7/1950 | Von Der Werth | 144/193 R |
| 3,650,168 | 3/1972 | Ruschmann | 83/114 |
| 3,674,219 | 7/1972 | Harvey, Jr. | 144/326 D |
| 3,727,850 | 4/1973 | Krigbaum | 241/159 |
| 3,797,765 | 3/1974 | Samuels | 241/236 |
| 3,862,651 | 1/1975 | Heikkinen | 144/3 K |
| 3,872,903 | 3/1975 | Carr | 144/193 R |
| 3,903,943 | 9/1975 | Hasenwinkle | 144/326 R |

FOREIGN PATENT DOCUMENTS

| | | | |
|---|---|---|---|
| 142885 | 8/1980 | Norway . | |
| 15279 | 9/1901 | Sweden . | |
| 482164 | 8/1975 | U.S.S.R. | 144/193 A |

OTHER PUBLICATIONS

Compression Slicing of Wood, Forest Products Journal, vol. 28, No. 7, Jul. 1978.

*Primary Examiner*—W. D. Bray

*Attorney, Agent, or Firm*—Schuyler, Banner, Birch, McKie & Beckett

[57] ABSTRACT

A process is disclosed for making long wood strands. Long wood strands are required in structural lumber products and in order to obtain maximum strength should be split along the grain. A method of splitting a log into longitudinal-grain wood strands is disclosed comprising the steps of radially splitting the log substantially along the grain of the log into a plurality of sector shaped segments, said radial splitting including pushing the log axially through at least one sector splitter ring, and further splitting the sector shaped segments substantially along the grain of the segments, said further splitting including feeding each of the sector shaped segments through two rows of intermeshing counter rotating discs, pulling each of the segments between the rows of discs and simultaneously splitting each of the segments into a plurality of longitudinal-grain wood strands.

4 Claims, 7 Drawing Figures

PROCESS FOR PREPARATION OF LONG WOOD STRANDS

This application is a continuation-in-part of co-pending U.S. application Ser. No. 885,985, (abandoned) filed Mar. 13, 1978.

This invention relates to long longitudinal-grain wood strands used in the preparation of adhesively bonded structural lumber products. More particularly, this invention relates to a method of splitting logs into long wood strands, having the grain in the strands running substantially along the length of the strands.

Long wood strands, with longitudinal grain extending along their length, are required for the production of adhesively bonded structural lumber products. An example of one type of structural lumber product is disclosed in U.S. Pat. No. 4,061,819, issued Dec. 6, 1977. The product disclosed in that patent is produced from substantially straight wood strands having lengths of at least twelve inches, average widths of 0.05 inch to 0.25 inch, and average thickness of 0.05 inch to 0.5 inch. Various methods have been used in the manufacture of long wood strands. In one method strands have been manufactured by peeling a log on a rotary veneer lathe and then cutting the veneer into strands on a shear. This method produces reasonably straight strands, but it has been found that the peeling step and the shearing step tend to cut across the grain in the wood. Thus the grain does not generally extend along the length of the strands. Similar problems occur with sawing which cuts right through the grain in the wood. Other methods include fibrillating wherein a log is crushed into a large number of strands. This method generally produces strands separated along the grain, but it is difficult to control the dimensions of the strands and it is also difficult to separate the strands. Thus, there is a high wastage of wood from the log, which lowers the yield.

This invention is directed to splitting wood, which is significantly different from sawing, slicing or shaving wood. When wood is split, a tapered metal blade is pressed into the wood until the wood on each side of the blade parts and a crack or split commences along the grain. The width of the metal blade is sufficient for this crack to extend in front of the tapered blade, thus once the wood has commenced splitting, the sharp tapered edge of the blade need not touch the wood. In the splitting of wood, the crack extending in front of the blade tends to follow the grain in the wood, and if the grain is twisted then the split will also be twisted. In the case of sawing, slicing or shaving, the blade is always in contact with the wood, and the wood is not supposed to crack or split in front of the blade.

The types of logs that can be split into strands are conventional saw logs and pulp logs that have grain extending generally in line from end to end of the logs. Some degree of unidirectional spiral grain is acceptable. However, logs with interlocking spiral grain are difficult to split and some limitations on knot size may be necessary depending on the size of the logs and the desired size of the strands.

An object of the invention is to provide a method of splitting logs substantially along the grain to produce longitudinal grain wood strands.

The present invention provides a method of splitting a log into longitudinal grain wood strands comprising the steps of, radially splitting the log substantially along the grain of the log into a plurality of sector shaped segments, said radial splitting including pushing the log axially through at least one sector splitter ring, and further splitting the sector shaped segments substantially along the grain of the segments, said further splitting including feeding each of the sector shaped segments through two rows of intermeshing counter rotating discs, pulling each of the segments between the rows of discs and simultaneously splitting each of the segments into a plurality of longitudinal-grain wood strands.

In drawings which illustrate embodiments of the invention,

Logs suitable for splitting are generally straight and meet normal requirements for conventional saw logs or pulp logs. The logs generally have a continuous grain extending from end to end. Small knots in a log generally pass through the splitting steps, producing a curved section in the strand. Large knots may need to be cut out before the second splitting step because they do not split but merely break up and in some cases tend to plug up the splitter.

The moisture content of the log is preferably maintained at not less than fibre saturation throughout all the splitting steps. Fibre saturation represents approximately a 30% moisture content varying slightly from one type of wood to another. High moisture content does not present a problem in splitting, but dry logs tend to resist pressure splitting, and more force is needed to push dry logs through a splitter. The length of logs to be split may be any convenient length. However, the preferred length is eight feet to twelve feet as this length of log produces strands which are easier to handle than excessively long ones.

In some cases it is preferable to debark a log before the splitting steps. The decision to debark depends on the type of wood being split and the end use of the wood strands. The debarking step has no bearing on the splitting steps which can be carried out on barked or debarked logs.

Figures 1, 2, 3:
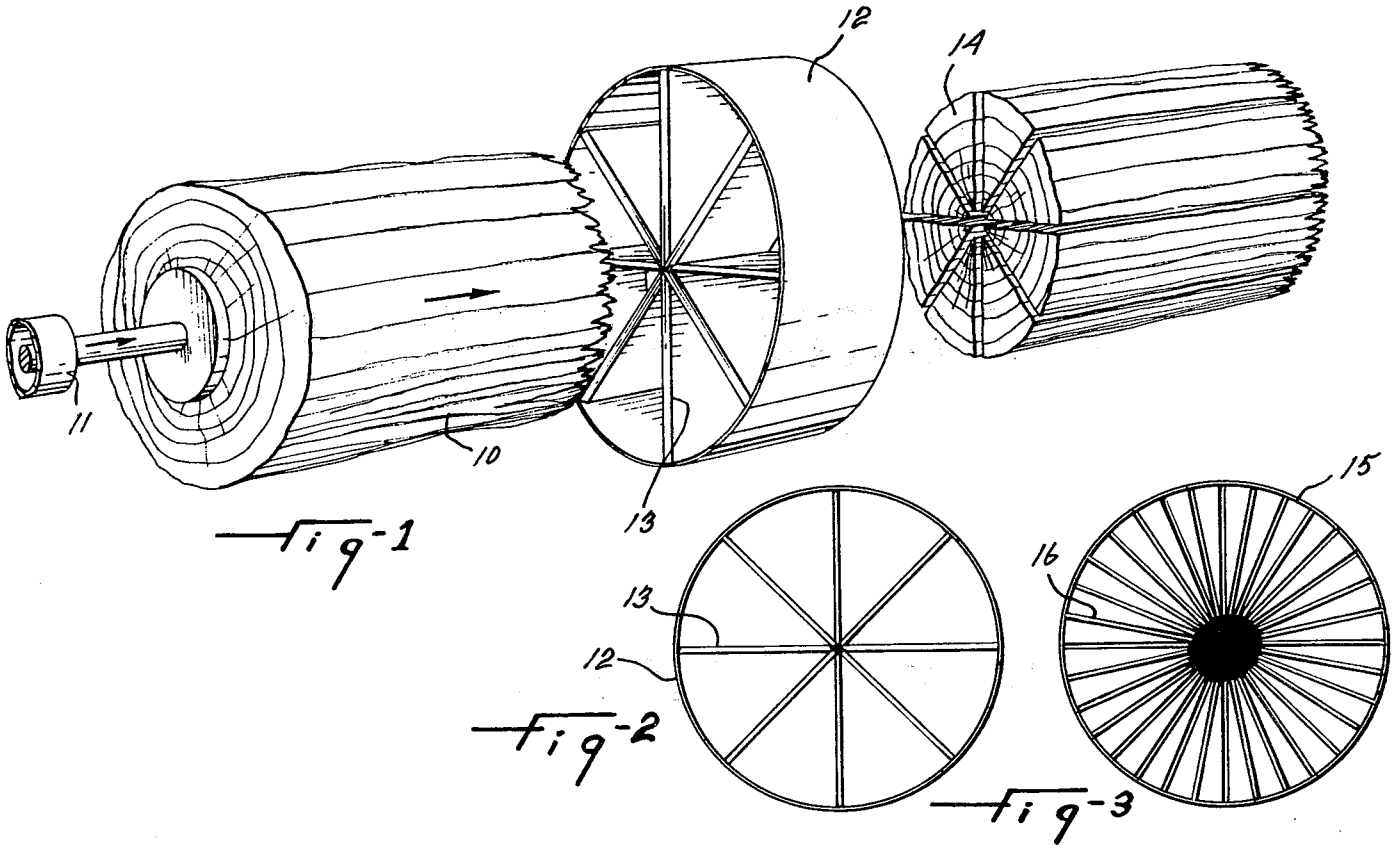
FIG. 1 illustrates a log passing through a sector splitter.
FIG. 2 is an elevation of an eight segment sector splitter.
FIG. 3 is an elevation of a thirty-two segment sector splitter.

Referring now to FIG. 1, a log 10 is shown ready to be pushed under pressure by a hydraulic cylinder 11 into a sector splitter ring 12. The sector splitter ring has blades 13 arranged to split a log into eight sector shaped segments 14. An elevation of a sector splitter 12 is shown in FIG. 2 where eight splitter blades 13 are provided and in FIG. 3, a sector splitter 15 is shown with thirty-two splitter blades 16 suitable for splitting a log into thirty-two sector shaped segments. In the splitter 15 two or three splitter rings in series may be used in place of one ring and the log is pushed through the splitter by means of the hydraulic cylinder 11. Desirably, a rotating backplate which can tilt to accommodate the back end of the log and which can rotate if a log with a spiral grain is moved through the splitter ring is provided as part of the splitter apparatus. A suitable splitter is disclosed in copending, U.S. patent application Ser. No. 199,188 entitled "Rotatable Splitter" filed concurrently herewith.

It will be apparent to those skilled in the art that a mechanical pusher such as a chain mechanism or a pneumatic cylinder may be substituted for the hydraulic cylinder 11. Any pushing means capable of exerting force on the end or along the length of the log may be employed.

Figure 4:
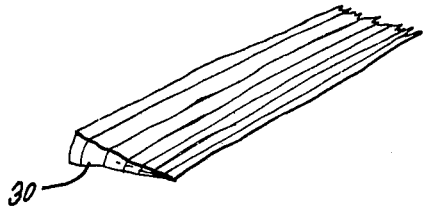
FIG. 4 illustrates a sector shaped segment produced on a sector splitter of the type shown in FIG. 3.

FIG. 4 shows a sector shaped segment 30 produced from the sector splitter 15 shown in FIG. 3 wherein the splitting blades 16 divide a log into thirty-two segments.

Figure 5:
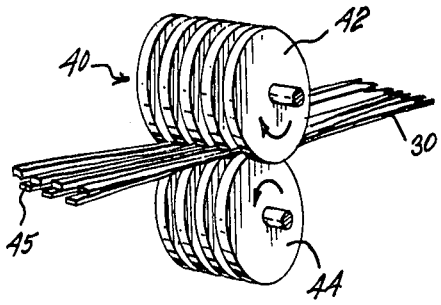
FIG. 5 illustrates a sector shaped segment of the type shown in FIG. 4 passing through a segment splitter, sometimes referred to as a strander.
Figure 6:
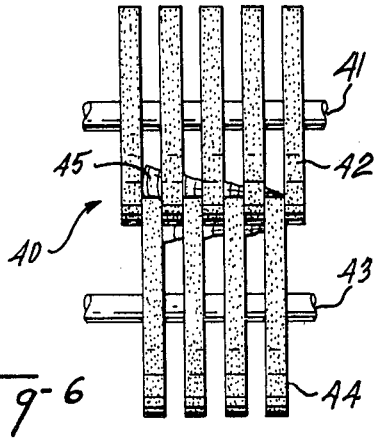
FIG. 6 is a cross-sectional elevation through the strand splitter shown in FIG. 5.
Figure 7:
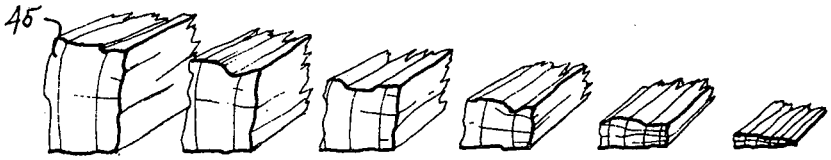
FIG. 7 illustrates a sector shaped segment of the type shown in FIG. 4 split into strands.

A segment 30 is then passed through a strander 40 as shown in FIGS. 5 and 6 which has an upper row 41 of spaced apart rotating discs 42 and a lower row 43 of spaced apart rotating discs 44 which intermesh with the top row 41 of discs 42. The discs are driven in counter rotational directions as indicated by the arrows on FIG. 5 and after an initial feed into the strander this rotational action pulls the segments 30 between the discs and splits the segment 30 into strands 45 through the strander 40. FIG. 7 shows strands 45 split from a sector shaped segment 30. The distance between all discs 42 in the strander 40 is preferably the same and is preferably in the range of $\frac{1}{8}$ to 1 inch. Thus, the strands produced have a preferred average width and average thickness in the range of $\frac{1}{8}$ to 1 inch. Width and thickness designate only a first and a second cross-section dimension of a strand. Either dimension can be termed "width" or "thickness".

The disc splitter can include floating spacer rings between each set of adjacent discs. These spacer rings are in contact with the strands that pass through the strander and prevent curling of the strands. If desired, rolls acting on the floating spacer rings may be included to ensure that contact between the spacer rings and the strands is at a point downstream of the center of the discs. A rotating disc strander is disclosed in copending U.S. patent application Ser. No. 199,182 entitled "Rotating Disc Splitter", filed concurrently herewith.

As may be seen in FIG. 7, the cross-sectional shape of the strands is often irregular. The action of splitting allows the crack or split to extend along the grain. Inasmuch as the grain in the wood is usually not even, the cross-section of resulting strands is usually irregular. This irregularity is immaterial as long as the strands generally follow the grain in the wood throughout their length.

Sector shaped segments such as the one shown in FIG. 4 may be split into strands by other types of segment splitters or stranders than that shown in FIGS. 5 and 6. One such segment splitter available on the market today is a grooved roll splitter, sometimes referred to as a tenderizer, which has two spaced apart rotating rolls. Each roll has a series of thin tapered discs which are in line with discs on the other roll. At one point the peripheries of the discs practically touch, and the segments are pushed between the rolls so that the discs aid in splitting the segments into strands. Other types of segment splitters include rotating tooth discs wherein a row of spaced apart rotating discs offset along a shaft splits segments pushed between two such rows of discs or one row and a flat surface.

In some situations, it is preferable to have a primary segment splitter followed by a secondary splitter or strander which splits the segments in two stages. A yield analysis on one twelve-inch diameter hemlock log processed through a sector splitter such as that shown in FIG. 1, and then through a primary grooved roll strander with a $\frac{3}{4}$ inch spacing followed by a secondary grooved roll strander with a $\frac{3}{8}$ inch spacing, gave the following:

| STRAND LENGTH (FT.) | YIELD (%) |
|---|---|
| 8 | 60 |
| 6 | 15 |
| 4 | 20 |
| 2 | 5 |
| | 100 |

Analysis of the process indicated that most of the length breakdown and wood loss arose from lateral movement of the segments entering the strander causing cutting across the grain, and from plugging occurring in the narrow grooves of the grooved roll stranders. This plugging prevented splitting of over-thick segments and hard knots. By changing the strander to the type shown in FIGS. 5 and 6, the yield values from the log improved.

It will be apparent to those skilled in the art that various changes may be made in the details of the process for preparation of long wood strands as described herein and shown in the drawings without departing from the scope of the present invention which is limited only by the claims.

We claim:

1. The method of splitting a log into longitudinal grain wood strands comprising the steps of, radially splitting the log substantially along the grain of the log into a plurality of sector shaped segments, said radial splitting including pushing the log axially through at least one sector splitter ring, and further splitting the sector shaped segments substantially along the grain of the segments, said further splitting including feeding each of the sector shaped segments through two rolls of intermeshing counter rotating parallel discs, pulling each of the segments between the rows of discs and simultaneously splitting each of the segments into a plurality of discrete longitudinal-grain wood strands whose surfaces generally follow the grain in the wood throughout their length.

2. The method according to claim 1 wherein the log has a moisture content for the radial splitting and the further splitting of at least fibre saturation.

3. The method according to claim 1 wherein the log is radially split into thirty-two sector shaped segments.

4. The method according to claim 1 wherein the wood strands have an average width and an average thickness in the range of $\frac{1}{8}$ to 1 inch.

* * * * *